US005873979A

United States Patent [19]

Naieni

[11] Patent Number: 5,873,979

[45] Date of Patent: Feb. 23, 1999

[54] PREPARING INDIVIDUALIZED POLYCARBOXYLIC ACID CROSSLINKED CELLULOSIC FIBERS

[75] Inventor: Shahrokh A. Naieni, Cincinnati, Ohio

[73] Assignee: The Procter & Gamble Company, Cincinnati, Ohio

[21] Appl. No.: 868,026

[22] Filed: Jun. 3, 1997

Related U.S. Application Data

[63] Continuation of Ser. No. 614,449, Mar. 12, 1996, abandoned, which is a continuation of Ser. No. 210,793, Mar. 18, 1994, abandoned.

[51] Int. Cl.[6] ..... D21C 9/00

[52] U.S. Cl. ..... 162/157.6; 162/9; 8/116.1

[58] Field of Search ..... 162/157.6, 100, 162/DIG. 3, 179, 9, 158, 182; 604/375, 376; 536/36, 56; 8/116.1, 120

[56] References Cited

U.S. PATENT DOCUMENTS

| | | | |
|---|---|---|---|
| Re. 26,939 | 8/1970 | Hervey et al. | 128/284 |
| 2,623,377 | 12/1952 | Dungler | 68/22 B |
| 2,932,602 | 4/1960 | Holgersson et al. | 162/158 |
| 2,999,045 | 9/1961 | Mitchell et al. | 162/77 |
| 3,224,926 | 12/1965 | Bernardin | 162/157.6 |
| 3,395,708 | 8/1968 | Hervey et al. | 128/284 |
| 3,440,135 | 4/1969 | Chung | 162/157 |
| 3,554,862 | 1/1971 | Hervey et al. | 162/158 |
| 3,554,863 | 1/1971 | Hervey et al. | 162/158 |
| 3,617,439 | 11/1971 | Chapman, Jr. | 162/158 |
| 3,677,886 | 7/1972 | Forssblad et al. | 162/72 |
| 3,700,549 | 10/1972 | Croon et al. | 162/157 |
| 3,809,604 | 5/1974 | Estes | 162/100 |
| 3,930,933 | 1/1976 | George et al. | 162/179 |
| 3,932,209 | 1/1976 | Chatterjee | 162/157.6 |
| 4,065,347 | 12/1977 | Aberg et al. | 162/26 |
| 4,144,122 | 3/1979 | Emanuelsson et al. | 162/158 |
| 4,303,471 | 12/1981 | Laursen | 162/158 |
| 4,351,699 | 9/1982 | Osborn, III | 162/112 |
| 4,425,186 | 1/1984 | May et al. | 162/158 |
| 4,432,833 | 2/1984 | Breese | 162/158 |
| 4,441,962 | 4/1984 | Osborn, III | 162/111 |
| 4,447,294 | 5/1984 | Osborn, III | 162/158 |
| 4,673,402 | 6/1987 | Weisman et al. | 604/368 |
| 4,798,603 | 1/1989 | Meyer et al. | 604/378 |
| 4,834,735 | 5/1989 | Alemany et al. | 604/368 |
| 4,935,022 | 6/1990 | Lash et al. | 604/368 |
| 4,940,513 | 7/1990 | Spendel | 162/112 |
| 4,988,345 | 1/1991 | Reising | 604/368 |
| 5,137,537 | 8/1992 | Herron et al. | 8/120 |
| 5,149,372 | 9/1992 | Ives | 118/412 |
| 5,217,445 | 6/1993 | Young et al. | 604/381 |
| 5,225,047 | 7/1993 | Graet et al. | 162/157.6 |

FOREIGN PATENT DOCUMENTS

| | | |
|---|---|---|
| 132128 | 1/1985 | European Pat. Off. . |
| 184603 | 6/1986 | European Pat. Off. . |
| 302521 | 2/1989 | European Pat. Off. . |
| 427317 | 5/1991 | European Pat. Off. . |
| 429112 | 5/1991 | European Pat. Off. . |
| 2256239 | 5/1973 | Germany . |
| 1407134 | 9/1975 | United Kingdom . |

OTHER PUBLICATIONS

DE 2,256,239, Germany, Eng. abstract, Derwent Pub. Ltd. 32479U–EF.

JP 64002648, Japan, Eng. abstract, Derwent Pub. Ltd. 89–051794/07.

(List continued on next page.)

*Primary Examiner*—Brenda A. Lamb
*Attorney, Agent, or Firm*—Dinsmore & Shohl LLP

[57] ABSTRACT

In preparing individualized polycarboxylic acid crosslinked fibers, defibration requirements are reduced to obtain a particular wet responsiveness and satisfactory absorbency properties are maintained even without washing or bleaching and washing, and improved dry resiliency is obtained, by using a reduced surface tension solution of polycarboxylic acid crosslinking agent.

20 Claims, 2 Drawing Sheets

OTHER PUBLICATIONS

SE 7401009, Sweden, Eng. abstract, Derwent Pub. Ltd. 54 288W/33.

Paper Chem No. 52–03738, Field, J.H., "Pulp Parameters Affecting Product Performance"; Mar.2–5, 1981.

Paper Chem No. 52–08709, Kolmodin, H., "Fluff, and Expanding Field of Application for Wood Fibers"; Sep. 8, 1981.

Paper Chem No. 52–12295, Shcherbakova, L.I. & Gorbushin, V.A., "Use of Surface–Active Agents to Improve the Properties of Fluffed Pulp"; 1977.

Paper Chem No. 53–05057, Field, J.H., "Pulp Parameters Affecting Product Performance"; Jul. 1982.

Paper Chem No. 53–06119, Field, J.H., "Absorbent Pulp Technology and Testing"; Apr. 19–21, 1982.

Paper Chem No. 54–09622, Insight 83 Absorbent Products Conference Nov. 16–17, 1983 San Antonio, TX.

Paper Chem No. 54–09745, Wahlen, S.L., "Debonding and Wetting Agents for Fluff Pulp"; Nov. 16–17, 1983.

Paper Chem No. 57–01619, Conte, J.S. & Bender, G.W., "Softening/Debonding Agents"; Apr. 16–18, 1986.

Paper Chem No. 57–06031, Cooper, D.J., Feaxel, T.A. & Smith, J.W., "Wood Pulp for Absorbent Products"; Apr. 20–23, 1986.

Paper Chem No. 58–13555, Mann, R.L. & Leah, P.J., "Fluff Pulp and Debonding Agents"; 11—Dec. 1987.

Paper Chem No. 62–00627, Grant, T. & Harding, M.J., "Fluff Pulps—Influences of Pulp Properties on Absorbent Properties"; Nov. 28–30, 1989.

PREPARING INDIVIDUALIZED POLYCARBOXYLIC ACID CROSSLINKED CELLULOSIC FIBERS

This is a continuation of application Ser. No. 08/614,449, filed Mar. 12, 1996, now abandoned which is a continuation of application Ser. No. 08/210,793, filed Mar. 18, 1994, now abandoned.

TECHNICAL FIELD

This invention is directed to an improved process for preparing cellulosic fibers for absorbent products and to product made thereby.

BACKGROUND OF THE INVENTION

Herron et al U.S. Pat. No. 5,137,537 is directed to absorbent structures comprising individualized, crosslinked cellulosic fibers having between about 0.5 and 10.0 mole % of a $C_2$–$C_9$ polycarboxylic acid crosslinking agent, calculated on a cellulose anhydroglucose molar basis, reacted with said fibers in an intrafiber ester crosslink bond form, wherein said crosslinked fibers have a water retention value of about 25 to about 60. The Herron et al invention has preferred application for high density (above 0.15 g/cc) absorbent products, e.g., thin disposable diapers, feminine hygiene napkins and adult incontinence products.

The preferred methods of fiber preparation in Herron et al involve dry curing, i.e., curing aqueous polycarboxylic acid fiber admixture of at least 60% consistency.

One dry curing method described in Herron et al comprises contacting uncrosslinked fibers in unrestrained form with aqueous crosslinking composition so as to obtain uniform penetration and distribution of crosslinking composition thereon, dewatering, optionally drying further, defibrating the fibers into substantially individual form, optionally drying further without disturbing the separation of fibers into individual form obtained by defibrating, curing to cause crosslinking to occur, and optionally washing or bleaching and washing.

In a second dry curing method described in Herron et al, processing is carried out as described in the above paragraph except that either before or after being contacted with the aqueous crosslinking composition, the fibers are provided in sheet form and while in sheet form are dried and cured and the cured fibers are defibrated into substantially individual form.

Consideration has been given to obtaining $C_2$–$C_9$ polycarboxylic acid crosslinked fibers while minimizing the cost of their production. Eliminating washing or bleaching and washing after curing reduces processing and equipment costs but also reduces the wet responsiveness of the absorbent product. Furthermore, reducing the amount of defibrating prior to curing reduces processing and equipment costs but also causes reduction in wet responsiveness and reduction in dry resiliency in the absorbent product and causes an increase in formation of balls of fibers which provide an appearance concern for the absorbent product.

SUMMARY OF THE INVENTION

It has been discovered herein that reducing the surface tension of the aqueous crosslinking composition accommodates for loss of wet responsiveness otherwise occurring on eliminating washing or bleaching and washing after curing and allows reducing of defibrating amount prior to curing without loss of wet responsiveness, as manifested by results in the wet compressibility test described hereinafter, and without harm to the appearance, as manifested by results in the knots and pills test, and improves dry resiliency, as manifested by results in the 5K density test described hereinafter.

The method herein is for preparing individualized, crosslinked cellulosic fibers having an effective amount of a $C_2$–$C_9$ polycarboxylic acid crosslinking agent reacted therein in an intrafiber ester crosslink bond form and improved dry resiliency (as manifested by results in the 5K density test described hereinafter), (i.e., crosslinked fibers as described in U.S. Pat. No. 5,137,537 but with improved dry resiliency), said method comprising the step of heating uncrosslinked cellulosic fibers at a moisture content ranging from 0 to about 70%, preferably ranging from 30 to 40%, with from 1 to 15%, by weight on a citric acid basis applied on a dry fiber basis, of $C_2$–$C_9$ polycarboxylic acid crosslinking agent, and from 0.005 to 1% by weight applied on a dry fiber basis, of surface active agent, thereon, to remove any moisture content and to cause the polycarboxylic acid crosslinking agent to react with the cellulosic fibers and form ester crosslinks between cellulose molecules (i.e., to cause curing), to provide said crosslinked cellulose fibers. In one embodiment, said method is carried out without washing or bleaching and washing of the crosslinked fibers.

Preparation of the uncrosslinked cellulosic fibers at a moisture content ranging from 0 to 70%, preferably from 30 to 40%, with from 1 to 15%, by weight on a citric acid basis applied on a dry fiber basis, of $C_2$–$C_9$ polycarboxylic acid crosslinking agent, and from 0.005 to 1% by weight, applied on a dry fiber basis, of surface active agent, thereon, preferably comprises contacting the uncrosslinked cellulosic fibers with an aqueous crosslinking composition which contains $C_2$–$C_9$ polycarboxylic acid crosslinking agent in an amount so as to provide from 1 to 15% thereof, by weight, on a citric acid basis applied on a dry fiber basis, on the fibers subjected to said heating step, and which contains surface active agent in an amount so as to provide from 0.005 to 1% thereof, by weight, applied on a dry fiber basis, on the fibers subjected to said heating step.

In a very preferred embodiment, said contacting is carried out by transporting a sheet of uncrosslinked cellulosic fibers having a moisture content ranging from 0 to 10% through a body of said aqueous crosslinking composition contained in a nip of press rolls and through said nip to impregnate said sheet of fibers with said aqueous crosslinking composition and to produce on the outlet side of the nip an impregnated sheet of fibers containing said aqueous crosslinking composition in an amount providing 30 to 80% or more (e.g., even up to 85% or 90% or even 95%), preferably 40 to 70%, consistency, and the impregnated sheet of fibers is subjected to defibration to produce a defibrated admixture which is ready for treatment in said heating step.

In another embodiment, the contacting is carried out by forming a slurry of uncrosslinked cellulosic fibers in unrestrained form in the aqueous crosslinking composition, of 0.1 to 20% consistency, and soaking for about 1 to 240 minutes, whereupon liquid is removed from the slurry to increase the consistency to range from 30 to 100% to form a liquid-reduced admixture, whereupon the liquid-reduced admixture is subjected to defibration to form a defibrated admixture which is ready for treatment in said heating step.

As indicated above, the presence of surface active agent to reduce surface tension in the heating step, causes increase in the wet responsiveness of the crosslinked fibers, as manifested by increased values in the wet compressibility test described hereinafter, to accommodate for loss in this property when washing or bleaching and washing steps after curing are omitted. While it is not the intention herein to be limited by any theory of why this occurs, it is believed the reduced surface tension prevents the fibers from shrinking during the reaction with crosslinking agent resulting in a more open structure in an absorbent article made from the fibers and better wet responsiveness.

As indicated above, the inclusion of surface active agent to reduce the surface tension in the aqueous crosslinking composition in the contacting causes pulp to become more easily defibrated (i.e., to become more fluffable), resulting in reduction in amount of defibration without loss of wet responsiveness in a structure made from the crosslinked fibers, as determined in the wet compressibility test described hereinafter, and with improvement in appearance, as determined in the knots and pills test described hereinafter. When commercially available disc fluffers are used for defibrating, said inclusion of surface active agent allows reduction of number of fluffers used to half of those otherwise required or to less than half of those otherwise required, to obtain preferred wet responsiveness and with improvement of appearance. While it is not the intention herein to be limited by any theory of why these advantages occur, it is believed the reduced surface tension decreases the fiber-to-fiber adhesiveness, thereby reducing amount of defibration to obtain preferred wet responsiveness.

As indicated above, the presence of surface active agent causes increase in dry resiliency for the crosslinked fiber product, as manifested by results in the 5K density test as described hereinafter.

The term "individualized, crosslinked fibers" is used herein to mean that crosslinks are primarily intrafiber rather than interfiber.

The term "intrafiber" means that a polycarboxylic acid molecule is reacted only with a molecule or molecules of a single fiber rather than between molecules of separate fibers.

The mole % of polycarboxylic acid crosslinking agent, calculated on a cellulose anhydroglucose molar basis, reacted with the fibers is determined by the following procedure: First a sample of the crosslinked fibers is washed with sufficient hot water to remove any unreacted crosslinking agent and catalysts.

Next, the fibers are dried to equilibrium moisture content. Then, the free carboxyl group content is determined essentially in accordance with T.A.P.P.I. method T237 OS-77. The mole % of reacted polycarboxylic acid crosslinking agent is then calculated based on the assumptions that one carboxyl group is left unreacted in each molecule of polycarboxylic acid, that the fibers before reaction have a carboxyl content of 30 meq/kg, that no new carboxyls are generated on cellulose molecules during the crosslinking process apart from the free carboxyls on crosslinking moieties and that the molecular weight of the crosslinked pulp fibers is 162 (i.e., one anhydroglucose unit).

The term "citric acid basis" is used herein to mean the weight of citric acid providing the same number of reacting carboxyl groups as are provided by the polycarboxylic acid actually used, with the reacting carboxyl groups being the reactive carboxyl groups less one per molecule. The term "reactive carboxyl groups" is defined later.

The term "applied on a dry fiber basis" means that the percentage is established by a ratio wherein the denominator is the weight of cellulosic fibers present if they were dry (i.e., no moisture content).

The "water retention values" set forth herein are determined by the following procedure: A sample of about 0.3 g to about 0.4 g of fibers (i.e., about a 0.3 g to about a 0.4 g portion of the fibers for which water retention value is being determined) is soaked in a covered container with about 100 ml distilled or deionized water at room temperature for between about 15 and about 20 hours. The soaked fibers are collected on a filter and transferred to an 80-mesh wire basket supported about 1 ½ inches above a 60-mesh screened bottom of a centrifuge tube. The tube is covered with a plastic cover and the sample is centrifuged at a relative centrifuge force of 1500 to 1700 gravities for 19 to 21 minutes. The centrifuged fibers are then removed from the basket and weighed. The weighed fibers are dried to a constant weight at 105° C. and reweighed. The water retention value (WRV) is calculated as follows:

$$WRV = \frac{(W - D)}{D} \times 100$$

where,

W=wet weight of the centrifuged fibers;

D=dry weight of the fibers; and

W-D=weight of absorbed water.

The wet compressibility test herein is a measure of wet responsiveness and absorbency in a structure made from the fibers for which the property is being determined and is carried out by the following procedure: An air laid four by four inch square pad weighing about 7.5 g is prepared from the fibers being tested. The density of the pad is adjusted to 0.2 g/cc with a press. The pad is loaded with synthetic urine to ten times its dry weight or to its saturation point, whichever is less. A 0.1 PSI compressional load is applied to the pad. After about 60 seconds, during which time the pad equilibrates, the compressional load is then increased to 1.1 PSI. The pad is allowed to equilibrate, and the compressional load is then reduced to 0.1 PSI. The pad is then allowed to equilibrate, and the thickness is measured. The density is calculated for the pad at the second 0.1 PSI load, i.e., based on the thickness measurement after the pad equilibrates after the compressional load is reduced to 0.1 PSI. The void volume, reported in cc/g, is then determined. The void volume is the reciprocal of the wet pad density minus the fiber volume (0.95 cc/g). This void volume is denoted the wet compressibility herein. Higher values indicate greater wet responsiveness.

The knots and pills test herein is a measure of the number of appearance defects (balls of fibers) in a structure made from the fibers for which the property is being determined and is carried out by the following procedure: A sample of fibers being tested (13.5 bone dried grams) is mixed with water to make up two liters (0.675% consistency). The sample is allowed to soak for a minimum of 5 minutes. The admixture is then transferred to a Tappi disintegrator and mixed therein for 2 minutes. The admixture is then diluted to 8 liters in a bucket. Then 5 handsheets (each about 1.3 g)) are made using a standard 743 ml handsheet cup (screen-covered sheet mold), i.e., by draining water from a pulp suspension added into the handsheet cup, through the screen thereof, leaving a sheet in the mold. Knots and pills (clumped up and rolled up fibers) of the wet sheets are counted over a light box. If a large number of knots and pills are present, then those in a square inch area are counted and multiplied by the total area (30.65 square inches for sheets made in a Papprix handsheet cup and 31.3 square inches for a sheet made in a Tappi handsheet cup). The readings on the 5 handsheets are averaged to provide the number of knots and pills. Higher values indicate more defects.

The 5K density test herein is a measure of fiber stiffness and of dry resiliency of a structure made from the fibers (i.e., ability of the structure to expand upon release of compressional force applied while the fibers are in substantially dry condition) and is carried out according to the following procedure: A four inch by four inch square air laid pad having a mass of about 7.5 g is prepared from the fibers for which dry resiliency is being determined, and compressed, in a dry state, by a hydraulic press to a pressure of 5000 psi, and the pressure is quickly released. The pad is inverted and the pressing is repeated and released. The thickness of the pad is measured after pressing with a no-load caliper (Ames thickness tester). Five thickness readings are taken, one in the center and 0.001 inches in from each of the four corners and the five values are averaged. The pad is trimmed to 4 inches by 4 inches and then is weighed. Density after pressing is then calculated as mass/(area×thickness). This density is denoted the 5K density herein. The lower the values in the 5K density test, i.e., the density after pressing, the greater the fiber stiffness and the greater the dry resiliency.

The drip capacity test herein is a combined measure of absorbent capacity and absorbency rate and is carried out herein by the following procedure: A four inch by four inch square air laid pad having a mass of about 7.5 g is prepared from the fibers for which drip capacity is being determined and is placed on a screen mesh. Synthetic urine is applied to the center of the pad at a rate of 8 ml/s. The flow of synthetic urine is halted when the first drop of synthetic urine escapes from the bottom or sides of the pad. The drip capacity is the difference in mass of the pad prior to and subsequent to introduction of the synthetic urine divided by the mass of the fibers, bone dry basis. The greater the drip capacity is, the better the absorbency properties.

The wicking rate test herein is a measure of the rate at which liquid wicks through a pad of fibers being tested and is determined herein by the following procedure: A four inch by four inch square air laid pad having a mass of about 3.5 g and a density of 0.2 g/cc is prepared from the fibers for which wicking rate is being determined. The test is carried out in a wicking rate tester. The wicking rate tester comprises a container and two lower electrodes with pins for inserting through a sample and two upper electrodes with pins for inserting through a sample and two vertically oriented plates for positioning in the container and a timer controlled to start when any of the two adjacent pins on the lower electrodes are contacted by liquid and to stop when any two adjacent pins on the upper electrodes are contacted by liquid. Synthetic urine is placed in the container of the wicking rate tester to provide a depth of 1 inch of synthetic urine therein. The pad of fibers being tested is place between the plates of the wicking rate tester with the pins of the lower electrodes being inserted through the entire thickness of the pad 7/12 inch from the bottom of the pad and the pins of the upper electrodes being inserted through the entire thickness of the pad 2 1/12 inch from the bottom of the pad and the assembly is inserted into the body of synthetic urine in the container of the tester so that the bottom 1/3 inch of the pad extends into the synthetic urine. The wicking rate in cm/s is 3.81 (the distance between the upper and lower electrodes in cm) divided by the time to wick from the lower electrodes in the upper electrodes as indicated by the timer. The larger the wicking rate, the faster the wicking.

The term "synthetic urine" is used herein to mean solution prepared from tap water and 10 grams of sodium chloride per liter of tap water and 0.51 ml of a 1.0% aqueous solution of Triton X100 (an octylphenoxy polyethoxy ethanol surfactant, available from Rohm & Haas Co.), per liter of tap water. The synthetic urine should be at 25°±1° C. when it is used.

The air laid pads referred to herein are made as follows: Air laying is carried out to air lay approximately 120 g of fibers into a 14" by 14" square on a piece of tissue and a second piece of tissue is then placed on top of the air laid mass to form a pad. The pad is pressed and cut into 4" by 4" squares.

The terms "defibration" and "defibrating" are used herein to refer to any procedure which may be used to mechanically separate fibers into substantially individual form even though they are already in such form, i.e., to the step(s) of mechanically treating fibers in either individual form or in more compacted form, where the treating (a) separates the fibers into substantially individual form if they were not already in such form and/or (b) imparts curl and twist to the fibers in dry state.

DETAILED DESCRIPTION

Figure 1:
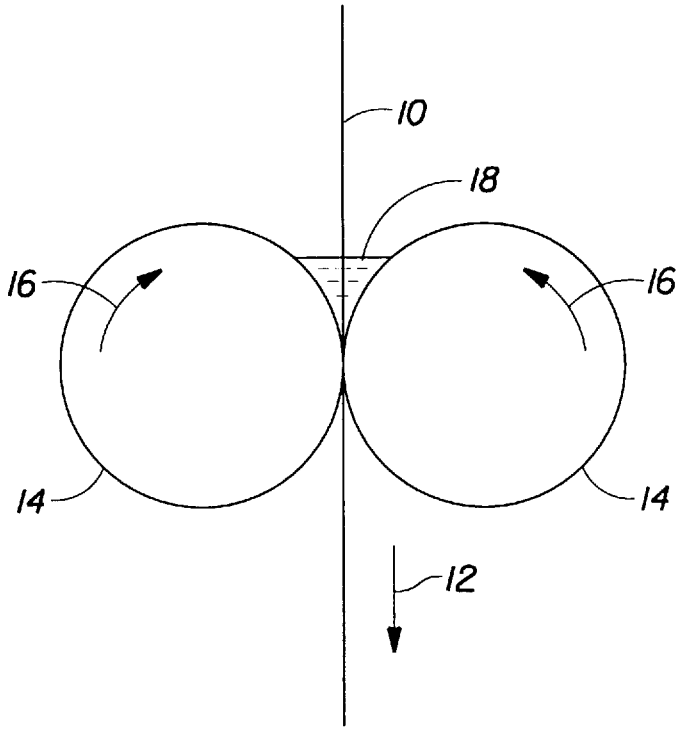
FIG. 1 schematically depicts a preferred method of contacting uncrosslinked fibers with aqueous crosslinking composition.

As indicated above, the method herein is for preparing individualized, crosslinked cellulosic fibers having effective amount of a $C_2$–$C_9$ polycarboxylic acid crosslinking agent reacted therein in an intrafiber ester crosslink bond form and improved dry resiliency. The term "effective amount" is used herein to mean an amount so as to provide fibers having a water retention value of from about 25 to about 60. U.S. Pat. No. 5,137,537 indicates that this may be about 0.5 mole % to about 10 mole percent $C_2$–$C_9$ polycarboxylic acid crosslinking agent, calculated on a cellulose anhydroglucose molar basis. The improved dry resiliency is a dry resiliency characterized by a 5K density of no more than 0.15 g/cc, preferably no more than 0.12 g/cc, typically ranging from 0.11 to 0.12 g/cc, as compared to a greater 5K density when the benefits of the invention are not obtained.

As indicated above, said method comprising the step of heating uncrosslinked cellulosic fibers at a moisture content ranging from 0 to 70%, preferably ranging from 30 to 40%, with from 1 to 15%, by weight on a citric acid basis applied on a dry fiber basis, of $C_2$–$C_9$ polycarboxylic acid crosslinking agent, and from 0.005 to 1% by weight applied on a dry fiber basis, of surface active agent, thereon, to remove any moisture content and to cause the polycarboxylic acid crosslinking agent to react with the cellulosic fibers and form ester crosslinks between cellulose molecules, to provide said crosslinked cellulose fibers. In one embodiment said method is carried out without washing or bleaching and washing of the crosslinked fibers. Preferably the $C_2$–$C_9$ polycarboxylic acid crosslinking agent is present in an amount of 3 to 12%, by weight on a citric acid basis applied on a dry fiber basis, and the surface active agent is present in an amount of 0.01 to 0.2%, by weight applied on a dry fiber basis.

Cellulosic fibers of diverse natural origin are applicable to the method herein. Digested fibers from softwood, hardwood or cotton linters are preferably utilized. Fibers from Esparto grass, bagasse, hemp, flax, and other lignaceous and cellulosic fiber sources may also be utilized as raw material in the invention. Typically, the fibers are wood pulp fibers made by chemical pulping processes. The fibers may be supplied in slurry, bulk or sheeted form. Fibers supplied as wet lap, dry lap or other sheeted form may be disintegrated prior to contacting the fibers with the crosslinking agent, e.g., by agitating in water or by mechanically disintegrating the sheet. Also, the fibers may be provided in a wet or moistened condition. Preferably, the fibers are obtained and utilized in dry lap form.

We turn now to the $C_2$–$C_9$ polycarboxylic acid crosslinking agents. These are organic acids containing two or more carboxyl (COOH) groups and from 2 to 9 carbon atoms in the chain or ring to which the carboxyl groups are attached; the carboxyl groups are not included when determining the number of carbon atoms in the chain or ring (e.g., 1,2,3 propane tricarboxylic acid would be considered to be a $C_3$ polycarboxylic acid containing three carboxyl groups and 1,2,3,4 butanetetracarboxylic acid would be considered to be a $C_4$ polycarboxylic acid containing four carboxyl groups). More specifically, the $C_2$–$C_9$ polycarboxylic acids suitable for use as crosslinking agents in the present invention include aliphatic and alicyclic acids either saturated or olefinically unsaturated, with at least three and preferably more carboxyl groups per molecule or with two carboxyl groups per molecule if a carbon-carbon double bond is present alpha, beta to one or both carboxyl groups. An additional requirement is that to be reactive in esterifying cellulose hydroxyl groups, a given carboxyl group in an aliphatic or alicyclic polycarboxylic acid must be separated from a second carboxyl group by no less than 2 carbon atoms and no more than three carbon atoms. Without being bound by theory, it appears from these requirements that for a carboxyl group to be reactive, it must be able to form a cyclic 5- or 6-membered anhydride ring with a neighboring carboxyl group in the polycarboxylic acid molecule. Where two carboxyl groups are separated by a carbon-carbon double bond or are both connected to the same ring, the two carboxyl groups must be in the cis configuration relative to each other if they are to interact in this manner. Thus a reactive carboxyl group is one separated from a second carboxyl group by no less than 2 carbon atoms and no more than 3 carbon atoms and where two carboxyl groups are separated by a carbon-carbon double bond or are both connected to the same ring, a reactive carboxyl group must be in cis configuration to another carboxyl group.

In aliphatic polycarboxylic acids containing three or more carboxyl groups per molecule, a hydroxyl group attached to a carbon atom alpha to a carboxyl group does not interfere with the esterification and crosslinking of the cellulosic fibers by the acid. Thus, polycarboxylic acids such as citric acid (also known as 2-hydroxy-1,2,3 propane tricarboxylic acid) and tartrate monosuccinic acids are suitable as crosslinking agents in the present invention.

The aliphatic or alicyclic $C_2$–$C_9$ polycarboxylic acid crosslinking agents may also contain an oxygen or sulfur atom(s) in the chain or ring to which the carboxyl groups are attached. Thus, polycarboxylic acids such as oxydisuccinic acid also known as 2,2'-oxybis(butanedioic acid), thiodisuccinic acid, and the like, are meant to be included within the scope of the invention. For purposes of the present invention, oxydisuccinic acid would be considered to be a $C_4$ polycarboxylic acid containing four carboxyl groups.

Examples of specific polycarboxylic acids which fall within the scope of this invention include the following: maleic acid, citraconic acid also known as methylmaleic acid, citric acid, itaconic acid also known as methylenesuccinic acid, tricarboxylic acid also known as 1,2,3 propane tricarboxylic acid, transaconitic acid also known as trans-1-propene-1,2,3-tricarboxylic acid, 1,2,3,4-butanetetracarboxylic acid, all-cis-1,2,3,4-cyclopentanetetracarboxylic acid, mellitic acid also known as benzenehexacarboxylic acid, and oxydisuccinic acid also known as 2,2'-oxybis(butanedioic acid). The above list of specific polycarboxylic acids is for exemplary purposes only, and is not intended to be all inclusive. Importantly, the crosslinking agent must be capable of reacting with at least two hydroxyl groups on proximately located cellulose chains in a single cellulosic fiber.

Preferably, the $C_2$–$C_9$ polycarboxylic acids used herein are aliphatic, and saturated, and contain at least three carboxyl groups per molecule. One group of preferred polycarboxylic acid agents for use with the present invention includes citric acid also known as 2-hydroxy-1,2,3 propane tricarboxylic acid, 1,2,3 propane tricarboxylic acid, and 1,2,3,4 butane tetracarboxylic acid. Citric acid is especially preferred, since it has provided fibers with high levels of wettability, absorbency and resiliency, which are safe and non-irritating to human skin, and has provided stable, crosslink bonds. Furthermore, citric acid is available in large quantities at relatively low prices, thereby making it commercially feasible for use as the crosslinking agent.

Another group of preferred crosslinking agents for use in the present invention includes saturated $C_2$–$C_9$ polycarboxylic acids containing at least one oxygen atom in the chain to which the carboxyl groups are attached. Examples of such compounds include oxydisuccinic acid, tartrate monosuccinic acid having the structural formula:

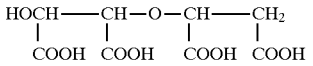

and tartrate disuccinic acid having the structural formula:

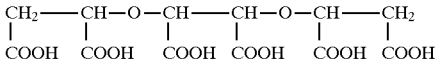

A more detailed description of tartrate monosuccinic acid, tartrate disuccinic acid, and salts thereof, can be found in Bushe et al U.S. Pat. No. 4,663,071, issued May 5, 1987, incorporated herein by reference.

Those knowledgeable in the area of polycarboxylic acids will recognize that the aliphatic and alicyclic $C_2$–$C_9$ polycarboxylic acid crosslinking agents described above may be reacted in a variety of forms to produce the crosslinked cellulosic fibers herein, such as the free acid form, and salts thereof. Although the free acid form is preferred, all such forms are meant to be included within the scope of the invention.

We turn now to the surface active agent. This can be a water-soluble nonionic, ampholytic, zwitterionic, anionic or cationic surfactants or of combinations of these. Nonionic surfactants are preferred. Preferred surface active agents of one group (sold under the Trade Name Pluronic® and described hereinafter) provide a surface tension at a level of 0.1% in water at 25° C. ranging from 42 to 53 dynes/cm with increase within this range providing higher values in the wicking rate test and higher values in the knots and pills test. Preferred surface active agents of another group (sold under the Trade Name Neodol® and described hereinafter) provide a surface tension at a level of 0.1% in water at 76° F. of 28 to 30 dynes/cm.

One class of nonionic surfactants consists of polyoxyethylene-polyoxypropylene polymeric compounds based on ethylene glycol, propylene glycol, glycerol, trimethylolpropane or ethylenediamine as the initiator reactive hydrogen compound. Preferred surfactants of this class are the compounds formed by condensing ethylene oxide with a hydrophobic base formed by the condensation of propylene oxide with propylene glycol. Average molecular weight (in grams per mole) normally ranges from about 1000 to 15000 and the molecular weight (grams per mole) of the hydrophobic portion generally falls in the range of about 900 to 4000. Preferably, the average molecular weight ranges from about 1000 to 5000, the molecular weight of the poly (oxypropylene) hydrophobe ranges from 900 to 2000 and poly(oxyethylene) hydrophilic unit is present in an amount ranging from 10 to 80% in the total molecule. Such synthetic nonionic surfactants are available on the market under the Trade Name of Pluronic® supplied by Wyandotte Chemicals Corporation. Especially preferred nonionic surfactants of this class are Pluronic® L31 (average molecular weight of 1100, molecular weight of poly(oxypropylene) hydrophobe of 950 and 10% poly(oxyethylene) hydrophilic unit by weight in the total molecule), Pluronic® L35 (average molecular weight of 1900, molecular weight of poly (oxypropylene) hydrophobe of 950 and 50% poly (oxyethylene) hydrophilic unit by weight in the total molecule), Pluronic® L62 (average molecular weight of 2500, molecular weight of poly(oxypropylene) hydrophobe of 1750 and 20% poly(oxyethylene) hydrophilic unit by weight in the total molecule) and Pluronic® F38 (average molecular weight of 4700, molecular weight of poly (oxypropylene) hydrophobic of 950, 80% poly(oxyethylene) hydrophilic unit by weight in the total molecule). Surface tensions for 0.1% aqueous solutions of these at 25° C. are as follows: Pluronic® L31, 46.9 dynes/cm; Pluronic® L35, 48.8 dynes/cm; Pluronic® L62, 42.8 dynes/cm; Pluronic® F38, 52.2 dynes/cm. Pluronic® L35 is most preferred.

Another class of nonionic surfactants consists of the condensation products of primary or secondary aliphatic alcohols or fatty acids having from 8 to 24 carbon atoms, in either straight chain or branched chain configuration, with from 2 to about 50 moles of ethylene oxide per mole of alcohol. Preferred are aliphatic alcohols comprising between 12 and 15 carbon atoms with from about 5 to 15, very preferably from about 6 to 8, moles of ethylene oxide per mole of aliphatic compound. The preferred surfactants are prepared from primary alcohols which are either linear such as those derived from natural fats or, prepared by the Ziegler process from ethylene, e.g., myristyl, cetyl, stearyl alcohols, e.g., Neodols (Neodol being a Trade Name of Shell Chemical Company) or partly branched such as the Lutensols (Lutensol being a Trade Name of BASF) and Dobanols (Dobanol being a Trade Name of Shell) which have about 25% 2-methyl branching, or Synperonics, which are understood to have about 50% 2-methyl branching (Synperonic being a Trade Name of I.C.I.) or the primary alcohols having more than 50% branched chain structure sold under the Trade Name Lial by Liquichimica. Specific examples of nonionic surfactants falling within the scope of the invention include Neodol 23-6.5, Neodol 25-7, Dobanol 45-4, Dobanol 45-7, Dobanol 45-9, Dobanol 91-2.5, Dobanol 91-3, Dobanol 91-4, Dobanol 91-6, Dobanol 91-8, Dobanol 23-6.5, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion containing between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule. Especially preferred nonionic surfactants of this class are Neodol 23-6.5 which is $C_{12-13}$ linear alcohol ethoxylated with an average of 6.7 moles of ethylene oxide per mole of alcohol and has a molecular weight of 488 grams/mole and Neodol 25-7 which is $C_{12-15}$ linear alcohol ethoxylated with an average of 7.3 moles of ethylene oxide and has a molecular weight of 524 grams/mole. Surface tensions for 0.1% solutions of Neodol 23-6.5 and Neodol 25-7 at 76° F. in distilled water are respectively 28 dynes/cm and 30 dynes/cm.

Another class of nonionic surfactants consists of the polyethylene oxide condensates of alkyl phenols, e.g., the condensation products of alkyl phenols having an alkyl group containing from 6 to 20 carbon atoms, in either a straight chain or branched chain configuration, with ethylene oxide, the said ethylene oxide being present in amounts equal to 4 to 50 moles of ethylene oxide per mole of alkyl phenol. Preferably the alkyl phenol contains about 8 to 18 carbon atoms in the alkyl group and about 6 to 15 moles of ethylene oxide per mole of alkyl phenol. The alkyl substituent in such compounds may be derived, for example, from polymerized propylene, di-isobutylene, octene and nonene. Other examples include dodecylphenol condensed with 9 moles of ethylene oxide per mole of phenol; dinonylphenol condensed with 11 moles of ethylene oxide per mole of phenol; nonylphenol and di-isooctylphenol condensed with 13 moles of ethylene oxide.

Another class of nonionic surfactants are the ethoxylated alcohols or acids or the polyoxypropylene, polyoxyethylene condensates which are capped with propylene oxide, butylene oxide, and/or short chain alcohols and/or short chain fatty acids, e.g., those containing from 1 to about 5 carbon atoms, and mixtures thereof.

Another class of nonionic surfactants are semi-polar nonionic surfactants including water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic, or aliphatic derivatives of, heterocyclic, secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants includes derivatives of aliphatic quaternary ammonium, phosphonium, and sulfonium compounds in which one of the aliphatic substituents contains from about 8 to 18 carbon atoms.

Useful anionic surfactants include water-soluble salts of the higher fatty acids, i.e., soaps. These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids, derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Cationic surfactants can also be included in the aqueous crosslinking composition to reduce its surface tension. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at solution pH values less than about 8.5. A more complete disclosure of these and other cationic surfactants useful herein can be found in U.S. Pat. No. 4,228,044, Cambre, issued Oct. 14, 1980, incorporated herein by reference.

As indicated above, preparation of the uncrosslinked cellulosic fibers with $C_2$–$C_9$ polycarboxylic acid and surface active agent thereon, for the heating stop herein, preferably comprises contacting the uncrosslinked cellulosic fibers with an aqueous crosslinking composition which contains $C_2$–$C_9$ polycarboxylic acid crosslinking agent in an amount so as to provide from 1 to 15% thereof, by weight, on a citric acid basis applied on a dry fiber basis, on the fibers subjected to said heating step and which contains surface active agent in an amount so as to provide from 0.005 to 1% thereof, by weight, applied on a dry fiber basis, on the fibers subjected to said heating step.

Preferably, the $C_2$–$C_9$ polycarboxylic acid crosslinking agent is present in the aqueous crosslinking composition in an amount so as to provide from 3 to 12% thereof, by weight, on a citric acid basis applied on a dry fiber basis, on the fibers subjected to said heating step. The higher the amount of said crosslinking agent present on the fibers subjected to the heating step, the greater the amount of crosslinking obtained.

Preferably, the surface active agent is present in the aqueous crosslinking composition in an amount so as to provide from 0.01 to 0.2% thereof by weight, applied on a dry fiber basis, on the fibers subjected to said heating step. If insufficient surface active agent is utilized, the benefits of the invention are not obtained. If too much surface active agent is utilized, wicking rates in product made from the crosslinked fibers can be reduced to an undesired level.

The pH of the aqueous crosslinking composition can be, for example, 1 to 5.0. The pHs below 1 are corrosive to the processing equipment. The pHs above 5.0 provide an impractically low reaction rate. The esterification reaction will not occur at alkaline pH. Increasing pH reduces reaction rate. The pH very preferably ranges from 1.5 to 3.5. The pH is readily adjusted upward if necessary, by addition of base, e.g., sodium hydroxide.

Catalyst is preferably included in said aqueous crosslinking composition to speed up the crosslinking reaction and protect brightness. The catalyst can be any which catalyzes the crosslinking reactions. Applicable catalysts include, for example, alkali metal hypophosphites, alkali metal phosphites, alkali metal polyphosphates, alkali metal phosphates, and alkali metal sulfates. Especially preferred catalysts are the alkali metal hypophosphites, alkali metal polyphosphates, and alkali metal sulfates. The mechanism of the catalysis is unknown, although the catalysts may simply be functioning as buffering agents, keeping the pH levels within the desired ranges. A more complete list of catalysts useful herein can be found in Welch et al U.S. Pat. No. 4,820,307, issued April 1989, incorporated herein by reference. The selected catalyst may be utilized as the sole catalyzing agent, or in combination with one or more other catalysts. The amount of catalyst preferably utilized is, of course, dependent upon the particular type and amount of crosslinking agent and the reaction conditions for the crosslinking reaction, especially temperature and pH. In general, based upon technical and economic considerations, catalyst levels of between about 5 wt. % and about 80 wt. %, based on the weight of crosslinking agent added to the cellulosic fibers, are preferred. For exemplary purposes, in the case wherein the catalyst utilized is sodium hypophosphite and the crosslinking agent is citric acid, a catalyst level of about 25 wt. %, based upon the amount of citric acid added, is preferred.

The contacting of the uncrosslinked cellulosic fibers with aqueous crosslinking composition should be carried out so as to obtain uniform distribution and penetration of the crosslinking composition onto the fibers.

Contacting the uncrosslinked cellulosic fibers with aqueous crosslinking composition is preferably carried out as schematically depicted in FIG. 1. With reference to FIG. 1, a sheet of uncrosslinked cellulosic fibers is transported along a pass line 10 in the direction indicted by arrow head 12 by the rotation of press rolls 14 in the directions indicated by arrows 16. A body of aqueous crosslinking composition 18 is maintained in the nip between the rolls. The sheet of fibers is transported through the body of aqueous crosslinking composition to impregnate the sheet of fibers with the aqueous crosslinking composition. The sheet of uncrosslinked cellulosic fibers entering the body of aqueous crosslinking composition normally has a moisture content ranging 0 to 10%. The time of the sheet of fibers in the body of aqueous crosslinking composition as determined by the rotation speed of the rolls 14, and the pressure of the rolls 14 exerted on the sheet of fibers passing therethrough, are regulated so that the appropriate amount of $C_2$–$C_9$ polycarboxylic acid crosslinking agent and surface active agent as specified hereinbefore are present on the fibers for the heating step. Preferably this is carried out to provide in the fiber sheet exiting from the press rolls an amount of aqueous crosslinking composition providing a consistency of 30 to 80% or more (e.g., up to 85% or 90% or even 95%), preferably of 40 to 70%, depending on the initial moisture content, and the concentration of the crosslinking agent and surface active agent, in the aqueous crosslinking composition, preferably to provide a target consistency for treatment in the heating step. The press roll speed is normally regulated to provide a time of the sheet of uncrosslinked fibers in the body of aqueous crosslinking composition ranging from 0.005 to 60 seconds, preferably from 0.05 to 5 seconds. In a less preferred alternative, the sheet of uncrosslinked fibers is impregnated with aqueous crosslinking composition to provide the aforementioned consistencies, by spraying. In either case, the liquid content of the impregnated sheet is optionally adjusted by mechanically pressing and/or by air drying.

The impregnated sheet of fibers, with optional adjustment of liquid content as described above, is preferably subjected to defibration prior to treatment in the heating step. Defibration is preferably performed by a method wherein knot and pill formation and fiber damage are minimized. Typically, a commercially available disc refiner is used. Another type of device which has been found to be useful for defibrating the cellulosic fibers is the three stage fluffing device described in U.S. Pat. No. 3,987,968, issued to D. R. Moore and O. A. Shields on Oct. 26, 1976, said patent being hereby expressly incorporated by reference into this disclosure. The fluffing device described in U.S. pat. No. 3,987,968 subjects moist cellulosic pulp fibers to a combination of mechanical impact, mechanical agitation, air agitation and a limited amount of air drying to create a substantially knot-free fluff. Other applicable methods of defibration include, but are not limited to, treatment in a Waring blender, tangentially contacting the fibers with a rotating wire brush, and hammermilling; Preferably, an air stream is directed toward the fibers during such defibration to aid in separating the fibers into substantially individualized form. Regardless of the particular mechanical device used to form the fluff, the fibers are preferably mechanically treated while initially containing between about 40% and 70% moisture. The individualized fibers have imparted thereto an enhanced degree of curl and twist relative to the amount of curl and twist naturally present in such fibers. It is believed that this additional curl and twist enhances the resilient character of structures made from the crosslinked fibers. The result of the defibrating is referred to herein as the defibrated admixture. The defibrated admixture is ready for the heating step. The impregnated sheet may be treated, for example, in a prebreaker (e.g., a screw conveyor) to disintegrate it, before defibration.

In examples of this method, a sheet of fibers of 0–10% moisture content (e.g., 6% moisture content is transported through a body of aqueous crosslinking composition to produce on the outlet side of the rolls an impregnated sheet of fibers of 60% consistency or 80% consistency which is subjected to defibration or an impregnated sheet of fibers of 40% consistency which is air dried to 60% consistency and then is subjected to defibration).

In a less preferred alternative, the impregnated sheet of fibers is treated in the heating step without prior disintegration, to produce a sheet of crosslinked cellulosic fibers, which optionally is subjected to defibration after the heating step.

Contacting the uncrosslinked cellulosic fibers with aqueous crosslinking composition may also be carried out by forming a slurry of the uncrosslinked fibers in unrestrained form in the aqueous crosslinking composition, of consistency ranging from 0.1 to 20% , very preferably from 2 to 15%, and maintaining the slurry for about 1 to 240 minutes, preferably for 5 to 60 minutes. The slurry can be formed, e.g., by causing a sheet of drylap to disintegrate by agitating it in the aqueous crosslinking composition.

A liquid removal step is normally next carried out to increase the consistency to one suitable for the heating step.

This is preferably carried out by dewatering (removing liquid) to provide a consistency ranging from about 30 to 80%, very preferably ranging from about 40 to 50% , and optionally thereafter drying further.

For exemplary purposes, dewatering may be accomplished by such methods as mechanically pressing or centrifuging. The product of the dewatering is typically denoted cake.

We turn now to the step wherein the cake may be dried further. This is typically carried out to provide a consistency within about a 35 to 80% consistency range, preferably to provide a consistency ranging from 50 to 70%, and is preferably performed under conditions such that utilization of high temperature for an extended period of time is not required, e.g., by a method known in the art as air drying. Excessively high temperature and time in this step may result in drying the fibers beyond 80% consistency, thereby possibly producing an undesired amount of fiber damage during an ensuing defibration.

The term "the liquid-reduced admixture" as used herein refers to the product of the liquid removal step.

The liquid-reduced admixture is typically subjected to defibration performed as described above in respect to an impregnated sheet except that the liquid-reduced admixture is subjected to defibration in place of the impregnated sheet. The result of the defibrating is referred to herein as the defibrated admixture.

The defibrated admixture or the liquid-reduced admixture in the case where defibration is omitted, is ready for the heating step.

We turn now to the heating of the uncrosslinked cellulosic fibers at a moisture content ranging from 0 to about 70%, preferably ranging from 30 to 40%, with from 1 to 15%, preferably 3 to 12%, by weight on a citric acid basis applied on a dry fiber basis, of $C_2$–$C_9$ polycarboxylic acid crosslinking agent, and from 0.005 to 1%, preferably 0.01 to 0.2%, by weight applied on a dry fiber basis surface active agent, thereon, to remove any moisture content and to cause the polycarboxylic acid crosslinking agent to react with the cellulosic fibers and form ester crosslinks between cellulose molecules to provide the product crosslinked cellulosic fibers.

In the case of treating fibers in unrestrained form, e.g., defibrated (fluffed) fibers, a moisture content removal portion of the heating step may be carried out in a first apparatus to dry to a consistency ranging from 60% to 100%, e.g., 90%, by a method known in the art as flash drying. This is carried out by transporting the fibers in a hot air stream, e.g., at an introductory air temperature ranging from 200° to 750° F., preferably at an introductory air temperature ranging from 300° to 550° F., until the target consistency is reached. This imparts additional twist and curl to the fibers as water is removed from them. While the amount of water removed by this drying step may be varied, it is believed that flash drying to the higher consistencies in the 60%to 100% range provides a greater level of fiber twist and curl than does flash drying to a consistency in the low part of the 60%–100% range. In the preferred embodiments, the fibers are dried to about 85%–95% consistency. Flash drying the fibers to a consistency, such as 85%–95%, in a higher portion of the 60%–100% range reduces the amount of drying which must be accomplished following flash drying. The subsequent portion of the heating step, or all of the heating step if flash drying is omitted, can involve heating for a period ranging from 5 seconds to 2 hours at a temperature ranging from 120° C. to 280° C. (air temperature in the heating apparatus), preferably at a temperature ranging from 145° to 190° C. (air temperature in the heating apparatus) for a period ranging from 2 minutes to 60 minutes in continuous air-through drying/curing apparatus (heating air is passed perpendicularly through a traveling bed of fibers) or in a static oven (fibers and air maintained stationary in a container with a stationary heating means), or other heating apparatus, to remove any remaining moisture content and to cause crosslinking reactions to occur which stiffen the fibers as a result of intrafiber crosslinking. The heating should be such that the temperature of the fibers does not exceed about 227° C. (440° F.) since the fibers can burst into flame at this temperature. The admixture is heated for an effective period of time to remove any remaining moisture content and to cause the crosslinking agent to react with the cellulosic fibers. The extent of reaction depends upon the dryness of the fiber, the time in the heating apparatus, the air temperature in the heating apparatus, pH, amount of catalyst and crosslinking agent and the method used for heating. Crosslinking at a particular temperature will occur at a higher rate for fibers of a certain initial moisture content with continuous, air-through drying/curing than with drying/curing in a static oven. Those skilled in the art will recognize that a number of temperature-time relationships exist. Temperatures from about 145° C. to about 165° C. (air temperature in the heating apparatus) for periods between about 30 minutes and 60 minutes, under static atmosphere conditions will generally provide acceptable drying/curing efficiencies for fibers having moisture contents less than about 10%. Those skilled in the art will also appreciate that higher temperatures and forced air convection (air-through heating) decrease the time required. Thus, temperatures ranging from about 170° C. to about 190° C. (air temperature in the heating apparatus) for periods between about 2 minutes and 20 minutes, in an air-through oven will also generally provide acceptable drying/curing efficiencies for fibers having moisture contents less than 10%.

Figure 2:
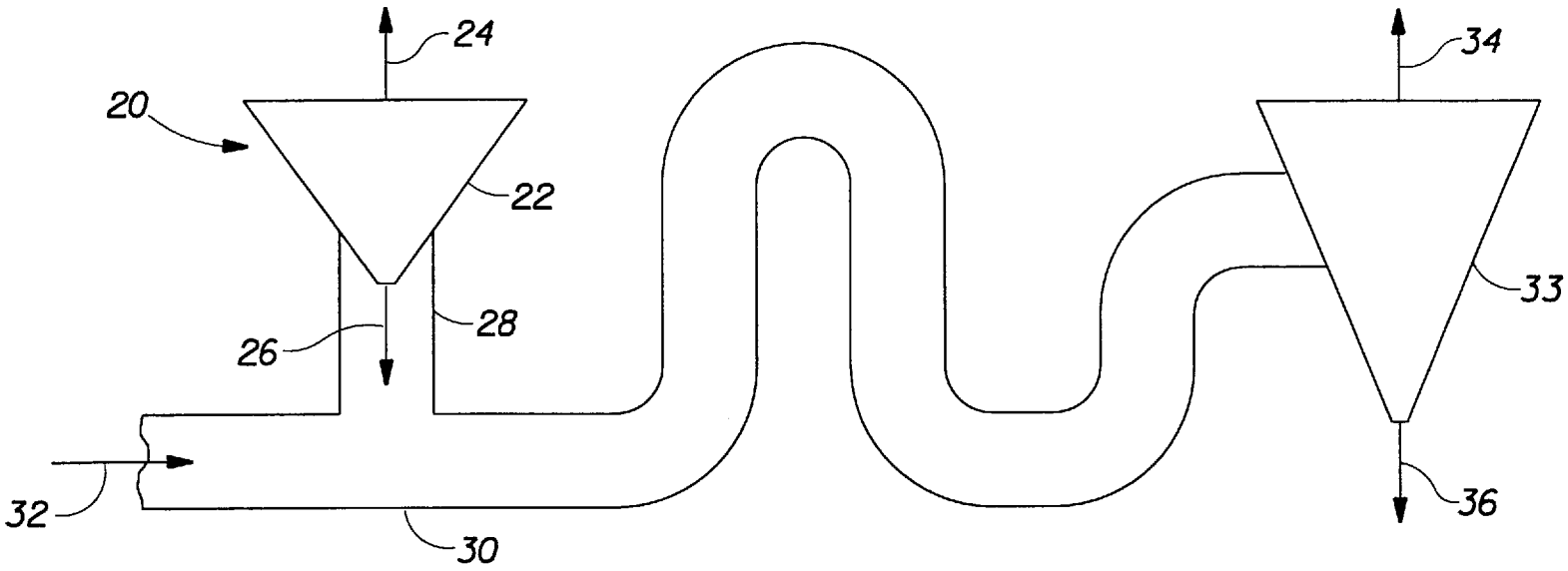
FIG. 2 schematically depicts an embodiment of heating to cause moisture removal and formation of ester crosslinks (curing) in the method herein.

In an alternative for completing the heating step after an initial flash drying step, flash drying and curing (or curing only, if the prior flash drying provides 100% consistency effluent) are carried out in apparatus as depicted in FIG. 2. With reference to FIG. 2, a stream 20 of air and fibers of 90 to 100% consistency, from a flash drier, is routed to a cyclone separator 22 which separates the air and fibers and discharges the air upwardly as indicated by arrow 24 and routes the fibers downwardly as indicated by arrow 26 into a duct 28 which discharges into a duct 30. Hot air (e.g., at 400° F.) from a furnace is directed into duct 30 as shown by arrow 32. The hot air carries the fibers along duct 30 which contains at least one U-shaped portion as depicted to provide a travel path which provides sufficient residence time to cause removal of any moisture content and to cause crosslinking reaction between fibers and polycarboxylic acid crosslinking agent to occur. The duct 30 discharges into a cyclone separator 33 which separates the air and fibers, discharging the air upwardly as indicated by arrow 34 and dried crosslinked cellulosic fibers downwardly as indicated by arrow 36. If necessary or desired, additional crosslinking may be carried out, e.g., in a subsequent static oven or air-through heating apparatus. The apparatus for the initial flash drying step may also be as depicted in FIG. 2 so that two or more sets of such apparatus are used in series as required by the need to bring in fresh dry air over the course of drying and curing.

The resulting crosslinked fibers (i.e., produced in any of the alternatives described above for application of the heating step to fibers in unrestrained form) are optionally moisturized, e.g., by spraying with water to provide 5 to 15% moisture content. This makes the fibers more resistant to damage that is of risk to occur due to subsequent handling or due to processing in making absorbent products from the fibers.

We turn now to the case where the heating step is carried out on the fibers in sheet form to dry the fibers and to cause the crosslinking reactions to occur. The same times and temperatures are applicable as described above for fibers in unrestrained form. Preferably, the heating is carried out at 145° C. to 190° C. (air temperature in the heating apparatus) for 2 to 60 minutes. After curing, the crosslinked fibers are optionally moisturized to 5 to 15% moisture content to provide resistance to damage from handling and optionally converted into substantially individualized form. The conversion to individualized form may be carried out utilizing a commercially available disc refiner or by treatment with fiber fluffing apparatus, such as the one described in U.S. Pat. No. 3,987,968. An effect of curing in sheet form is that fiber-to-fiber bonding restrains the fibers from twisting and curling compared to where individualized crosslinked fibers are made with curing under substantially unrestrained conditions. The fibers made in this way would be expected to provide structures exhibiting less absorbency and wettability than in the case of the fibers cured in unrestrained form.

Another embodiment is the same as the embodiments described above except that (a) washing or (b) bleaching and washing steps are included. The advantage of the invention in this embodiment resides in reduced defibration requirements to produce fibers with a particular wet responsiveness and in improved dry resiliency.

One washing sequence comprises allowing the fibers to soak in aqueous washing solution for an appreciable time, e.g., 30 minutes to 1 hour, screening the fibers, dewatering the fibers, e.g., by centrifuging, to a consistency between about 50% and about 80%, defibrating the dewatered fibers and air drying. Preferably, a sufficient amount of acidic substance is added to the wash solution to keep the wash solution at a pH of less than about 7 to inhibit reversion of crosslinks. This washing sequence has been found to reduce residual free crosslinking agent content.

Any bleaching is normally carried out without substantially decreasing the $C_2$–$C_9$ polycarboxylic acid moiety content. This is accomplished, for example, by using an acidic bleaching agent, e.g., chlorine dioxide. An example of bleaching with clorine dioxide is as follows: The crosslinked fibers are mixed with water to provide a 10% consistency (10 g fibers to 90 g water). Chlorine dioxide is added to the mixture to obtain 3% available chlorine. This admixture is maintained at 70° C. for 180 minutes. Then the admixture is dewatered by centrifuging, washed and dried.

The invention is illustrated by the following Examples. In all the Examples and Reference Examples, the WRV of the resulting fibers is about 35. In the examples, the wet compressibilities, 5K densities, knots and pills, drip capacities and wicking rates are determined as set forth hereinbefore.

REFERENCE EXAMPLE I

Three hundred grams (on a bone dry basis, i.e., moisture-free basis) of southern softwood Kraft fibers in the form of drylap sheets were dispersed in aqueous solution containing 551.57 g of citric acid, 137.89 g of sodium hypophosphite, and 63 g of sodium hydroxide, by dipping, and mixing with a paddle wheel mixer, to form a slurry of 2.5% consistency. The fibers were soaked in the slurry for about 30 minutes. This mixture was centrifuged to provide a dewatered cake of about 44% consistency. The dewatered cake, containing about 6% by weight citric acid on a dry fiber basis, was air dried to about 50% consistency. The air dried cake was fluffed in a disc refiner at a throughput rate of 60 g/min, flash dried to a consistency of 90% and heated for 6 minutes at an air temperature of 350° F. in an air-through oven and then air cooled with a fan to less than 150° F. There was no washing or bleaching after curing. Testing results indicated a wet compressibility of 6.6 cc/g, a 5K density of 0.137 g/cc, 157 knots and pills, a drip capacity of 11.3 g/g and a wicking rate of 0.79 cm/sec.

REFERENCE EXAMPLE II

Esterified fibers were prepared as in Reference Example I except that the throughput rate through the disc refiner was 180 g/min. Testing results indicated a wet compressibility of 6.5 cc/g, a 5K density of 0.144 g/cc, 567 knots and pills, a drip capacity of 10.6 g/g and a wicking rate of 0.73 cm/sec.

EXAMPLE I

Esterified fibers were prepared as in Reference Example I except that Pluronic® L35 was included. The dewatered cake contained about 6% by weight citric acid on a dry fiber basis and about 0.075% Pluronic® L35 on a dry fiber basis. Testing results indicated a wet compressibility of 7.1 cc/g, a 5K density of 0.12 g/cc, 7 knots and pills, a drip capacity of 11.3 g/g and a wicking rate of 0.55 cm/sec.

EXAMPLE II

Esterified fibers were prepared as in Reference Example II except that 2.30 g of Pluronic® L35 was included to provide 0.025% Pluronic® L35 in the dewatered cake on a dry fiber basis. Testing results indicated a wet compressibility of 6.92 cc/g, a 5K density of 0.116 g/cc, 17.8 knots and pills, a drip capacity of 11.68 g/g and a wicking rate of 0.59 cm/sec.

EXAMPLE III

Esterified fibers were prepared as in Example II except that 4.60 g of Pluronic® L35 was included to provide 0.05% Pluronic® L35 in the dewatered cake on a dry fiber basis. Testing results indicated a wet compressibility of 7.25 cc/g, a 5K density of 0.118 g/cc, 4.6 knots and pills, a drip capacity of 12.55 g/g and a wicking rate of 0.53 cm/sec.

EXAMPLE IV

Esterified fibers were prepared as in Example II except that 6.89 g of Pluronic® L35 was included to provide 0.075% Pluronic® L35 in the dewatered cake on a dry fiber basis. Testing results indicated a wet compressibility of 7.31 cc/g, a 5K density of 0.113 g/cc, 6.8 knots and pills, a drip capacity of 12.73 g/g and a wicking rate of 0.64 cm/sec.

EXAMPLE V

Esterified fibers were prepared as in Example II except that 9.19 g of Pluronic® L35 was included to provide 0.10% Pluronic® L35 in the dewatered cake on a dry fiber basis. Testing results indicated a wet compressibility of 7.05 cc/g, a 5K density of 0.115 g/cc, a drip capacity of 11.55 g/g and a wicking rate of 0.55 cm/sec.

EXAMPLE VI

Esterified fibers were prepared as in Example II except that 6.89 g of Pluronic® L31 was included to provide 0.075% Pluronic® L31 in the dewatered cake on a dry fiber basis. Testing results indicated a wet compressibility of 7.05 cc/g, a 5K density of 0.114 g/cc, 3.6 knots and pills, a drip capacity of 10.87 g/g and a wicking rate of 0.61 cm/sec.

EXAMPLE VII

Esterified fibers were prepared as in Example II except that 4.60 g of Pluronic® F38 was included to provide 0.05% Pluronic® F38 in the dewatered cake on a dry fiber basis. Testing results indicated a wet compressibility of 7.38 cc/g, a 5K density of 0.123 g/cc, 6.4 knots and pills, a drip capacity of 11.77 g/g and a wicking rate of 0.65 cm/sec.

EXAMPLE VIII

Esterified fibers were prepared as in Example II except that 9.19 g of Pluronic® L62 was included to provide 0.10% Pluronic® L62 in the dewatered cake on a fiber basis. Testing results indicated a wet compressibility of 7.33 cc/g, a 5K density of 0.117 g/cc, 3.8 knots and pills, a drip capacity of 10.85 g/g and a wicking rate of 0.45 cm/sec.

EXAMPLE IX

Crosslinked fibers were prepared from southern softwood Kraft fibers using citric acid as the crosslinking agent and Neodol 23-6.5 as the surface active agent. In the preparation, a 2.5% consistency slurry having a pH of 3.0 was formed from 200 g bone dry pulp, 367.7 g citric acid and 20.2 g Neodol 236.5 and sodium hydroxide. After about 30 minutes of soaking, the admixture was centrifuged to a consistency of 46.9%. The resultant dewatered cake contained 5.33% by weight citric acid and about 0.33% Neodol 23-6.5 on a dry fiber basis. The dewatered cake was fluffed in a disc refiner at a throughput rate of 60 g/min. A flash drier attached to the disc refiner reduced the moisture content to provide 92.9% consistency admixture. Heating was then carried out on the 92.9% consistency admixture for 8 minutes at an air temperature of 370° F. in a Proctor & Schwartz gas oven. The product was rinsed for 5 minutes in cold water, soaked for 1 hour in 60° C. water, rinsed for 5 minutes in cold water, centrifuged for 5 minutes, and air dried to 90% consistency. Testing indicated a 5K density of 0.109 g/cc, 6.5 knots and pills, and a drip capacity of 14.3 g/g.

EXAMPLE X

Esterified fibers were prepared as in Example IX except that the surface active agent was Neodol 25-7, dewatering was to 43.9% consistency, the dewatered cake contained 6.02% by weight citric acid and 0.33% Neodol 25-7 on a dry fiber basis, the dewatered cake was air dried to 46% consistency and air dried cake was fluffed. Testing indicated a 5K density of 0.106 g/cc, 12.2 knots and pills, and a drip capacity of 13.9 g/g.

EXAMPLE XI

Esterified fibers are made using the system depicted in FIG. 1 having rolls 1 foot in diameter and 6 feet wide. Southern softwood Kraft drylap of initial moisture content of 6% (94% consistency) is used. The aqueous crosslinking composition contains citric acid, Pluronic® L35, sodium hypophosphite and sodium hydroxide to adjust the pH to 3. The roll speed is such that the residence time of fibers of the drylap sheet in the aqueous crosslinking composition is 0.1 sec. Typical pressure at the nip of the press rolls is 45 psi and 45 lbs per linear inch. The consistency of the sheet on the outlet side of the press rolls is about 60%. The sheet leaving the press rolls contains 6% by weight citric acid on a dry fiber basis and 0.075% by weight Pluronic® L35 on a dry fiber basis. The impregnated sheet is first broken up into chunks and then fluffed in a disc refiner. Flash drying is then carried out to 90% consistency. Further drying and curing is carried out in the system of FIG. 2 using 400° F. air. If necessary, further heating is carried out in an air-through heating apparatus or static oven maintained at an air temperature of about 350° F. In an alternative procedure, esterified fibers are prepared as described except that the consistency of the sheet leaving the press rolls is about 40% and the impregnated sheet is air dried to 60% consistency prior to fluffing. In both cases, results similar to those obtained in Example I are obtained.

Variations will be obvious to those skilled in the art. Therefore, the invention is defined by the claims.

What is claimed is:

1. In an absorbent structure comprising individualized, crosslinked cellulosic fibers having an amount of $C_2$–$C_9$ polycarboxylic acid crosslinking agent reacted therein in an intrafiber ester crosslink bond form providing said crosslinked fibers with a water retention value of from about 25 to 60, an improved method of manufacture of said crosslinked cellulosic fibers, said method comprising the steps of:

a. contacting uncrosslinked cellulosic fibers with an aqueous crosslinking composition comprising $C_2$–$C_9$ polycarboxylic acid crosslinking agent and surface active agent and having a pH in the range of from 1.5 to 3.5; and b. heating uncrosslinked cellulosic fibers having a moisture content ranging from 0 to about 70%, together with from 1 to 15%, by weight on a citric acid basis applied on a dry fiber basis of $C_2$–$C_9$ polycarboxylic acid crosslinking agent, together with from 0.005 to 1% by weight, applied on a dry fiber basis, of surface active agent, to remove any moisture content and to cause the polycarboxylic acid crosslinking agent to react with the cellulose fibers and form ester crosslinks between cellulose molecules, to provide said crosslinked cellulosic fibers, said surface active agent causing improved stiffness and wet responsiveness in said crosslinked fibers; wherein the 5K density of the crosslinked fibers is no more than 0.12 g/cc and wherein the absorbent structure has a wicking rate of from 0.45 cm/sec to 6.5 cm/sec.

2. The method of claim 1 wherein the uncrosslinked fibers subjected to the heating step are at a moisture content of 30 to 40%, the uncrosslinked cellulosic fibers have from 3 to 12%, by weight on a citric acid basis applied on a dry fiber basis, of $C_2$–$C_9$ polycarboxylic acid crosslinking agent and from 0.01 to 0.2%, by weight applied on a dry fiber basis, of surface active agent, thereon, the $C_2$–$C_9$ polycarboxylic acid crosslinking agent is citric acid, and the surface active agent is a nonionic surfactant.

3. The method of claim 2 wherein the nonionic surfactant is one formed by condensing ethylene oxide with a hydrophobic base formed by condensation of propylene oxide with propylene glycol.

4. The method of claim 2 wherein the nonionic surfactant is condensation product of $C_{12}$–$C_{15}$ aliphatic alcohol with from 5 to 15 moles of ethylene oxide.

5. The method of claim 1 further comprising prior to the heating step a step of defibrating the uncrosslinked cellulosic fibers to provide a defibrated admixture and optionally removing liquid between the contacting and the defibrating steps.

6. The method of claim 5 wherein the heating step comprises flash drying the defibrated admixture to dry the defibrated admixture to a consistency of between 60% and 100%.

7. The method of claim 6 wherein the flash drying is to 85 to 95% consistency.

8. The method of claim 6 wherein the dried defibrated admixture from the flash drying step is heated for a period ranging from 5 seconds to 2 hours at an air temperature of 120° C. to 280° C. to remove any remaining moisture content and cause crosslinking to occur.

9. The method of claim 5 wherein said contacting is carried out by transporting a sheet of uncrosslinked cellulosic fibers having a moisture content of 0 to 10% through a body of said aqueous crosslinking composition contained in a nip of press rolls and through said nip to impregnate said sheet of fibers with said aqueous crosslinking composition and to produce on the outlet side of the nip an impregnated sheet of fibers containing said aqueous crosslinking composition in an amount to provide 30 to 80% consistency, and the impregnated sheet of fibers is subjected to defibration in the defibration step to produce a the defibrated admixture which is ready for treatment in the heating step.

10. The method of claim 5 wherein the contacting is carried out by forming a slurry of uncrosslinked cellulosic fibers in unrestrained form in the aqueous crosslinking composition, of 0.1 to 20% consistency, and soaking for about 1 to 240 minutes, whereupon liquid is removed from the slurry to increase the consistency from 30 to 100% to form a liquid-reduced admixture, whereupon the liquid-reduced admixture is subjected to defibration in the defibration step to form the defibrated admixture which is ready for treating in the heating step.

11. The method of claim 1 which is carried out without washing or bleaching and washing of the crosslinked fibers.

12. A product made by the process of claim 11 having a 5K density of from 0.11 to 0.12 g/cc.

13. A product made by the process of claim 1 having a 5K density of from 0.11 to 0.12 g/cc.

14. A method of preparing individualized, crosslinked cellulosic fibers having an amount of $C_2$–$C_9$ polycarboxylic acid crosslinking agent reacted therein in an intrafiber ester crosslink bond form comprising the step of:

a. contacting a sheet of uncrosslinked cellulosic fibers with an aqueous crosslinking composition comprising a $C_2$–$C_9$ polycarboxylic acid crosslinking agent and a surface active agent and having a pH in the range of from 1.5 to 3;

b. subsequently defibrating the sheet of uncrosslinked cellulosic fibers to form a defibrated admixture; and c. heating the defibrated admixture thereby forming the individualized, crosslinked cellulosic fibers;

wherein the 5K density of the crosslinked fibers is no more than 0.12 g/cc.

15. A method according to claim 14, wherein the step of heating the defibrated admixture comprises the step of heating the uncrosslinked cellulosic fibers at a moisture content of from 0% to about 70% with from 1% to 15%, by weight on a citric acid basis applied on a dry fiber basis, of the $C_2$–$C_9$ polycarboxylic acid crosslinking agent and from 0.005% to 1%, by weight applied on a dry fiber basis, of the surface active agent.

16. A method according to claim 14, wherein the surface active agent is a nonionic agent selected from the group consisting of condensation products of ethylene oxide with a hydrophobic base formed by the condensation of propylene oxide with propylene glycol, the condensation products of $C_8$–$C_{24}$ aliphatic alcohols with from about 2 to about 50 moles ethylene. oxide per mole alcohol, and mixtures thereof; and further wherein a pad of the individualized, crosslinked fibers has a wicking rate of from 0.45 cm/sec to 6.5 cm/sec.

17. A method of preparing individualized, crosslinked cellulosic fibers having an amount of $C_2$–$C_9$ polycarboxylic acid crosslinking agent reacted therein in an intrafiber ester crosslink bond form comprising the step of:

a. forming a slurry of 0.1% to 20% consistency comprising unrestrained uncrosslinked cellulosic fibers and an aqueous crosslinking composition comprising a $C_2$–$C_9$ polycarboxylic acid crosslinking agent and a surface active agent and having a pH in the range of from 1.5 to 3;

b. soaking the slurry for about 1 to 240 minutes;

c. removing liquid from the slurry thereby forming a liquid-reduced admixture;

d. defibrating the liquid-reduced admixture to form a defibrated admixture; and e. heating the defibrated admixture thereby forming the individualized, crosslinked cellulosic fibers;

wherein the 5K density of the individualized, crosslinked fibers is no more than 0.12 g/cc.

18. A method according to claim 17, wherein the step of heating the defibrated admixture comprises the step of heating the uncrosslinked cellulosic fibers at a moisture content of from 0% to about 70% with from 1% to 15%, by weight on a citric acid basis applied on a dry fiber basis, of the $C_2$–$C_9$ polycarboxylic acid crosslinking agent and from 0.005% to 1%, by weight applied on a dry fiber basis, of the surface active agent.

19. A method according to claim 17, further comprising the step of drying the liquid-reduced admixture to a consistency of from about 35% to 80% prior to defibration.

20. A method according to claim 17, wherein the surface active agent is a nonionic agent selected from the group consisting of condensation products of ethylene oxide with a hydrophobic base formed by the condensation of propylene oxide with propylene glycol, the condensation products of $C_8$–$C_{24}$ aliphatic alcohols with from about 2 to about 50 moles ethylene oxide per mole alcohol, and mixtures thereof, and further wherein a pad of the individualized, crosslinked fibers has a wicking rate of from 0.45 cm/sec to 6.5 cm/sec.

* * * * *

UNITED STATES PATENT AND TRADEMARK OFFICE

CERTIFICATE OF CORRECTION

PATENT NO. : 5,873,979
DATED : February 23, 1999
INVENTOR(S) : Shahrokh Naieni

It is certified that error appears in the above-identified patent and that said Letters Patent is hereby corrected as shown below:

Column 20, line 62, delete "step" and insert in place thereof --steps--.
Column 21, line 21, delete the period "." after "ethylene".
Column 21, line 28, delete "step" and insert thereof --steps--.

Signed and Sealed this

Thirteenth Day of July, 1999

*Attest:*

*Attesting Officer*

Q. TODD DICKINSON

*Acting Commissioner of Patents and Trademarks*